United States Patent [19]

Woxholt

[11] Patent Number: 4,677,816

[45] Date of Patent: Jul. 7, 1987

[54] STRANDING MACHINE

[75] Inventor: Stanley Woxholt, Vereeniging, South Africa

[73] Assignee: Sharon Wire Mill Corporation (Proprietary) Limited, Transvaal Province, South Africa

[21] Appl. No.: 809,330

[22] Filed: Dec. 16, 1985

[30] Foreign Application Priority Data

Dec. 18, 1984 [ZA] South Africa ..... 84/9847

[51] Int. Cl.[4] ..... D07B 3/00

[52] U.S. Cl. ..... 57/59

[58] Field of Search ..... 57/13, 59, 90, 62, 63

[56] References Cited

U.S. PATENT DOCUMENTS

| | | | |
|---|---|---|---|
| 2,886,939 | 5/1959 | Wilks | 57/59 X |
| 3,360,919 | 1/1968 | Burr | 57/59 |
| 4,073,127 | 2/1978 | Orlandi et al. | 57/59 X |
| 4,407,116 | 10/1983 | Henrich | 57/13 |
| 4,519,197 | 5/1985 | Borroni | 57/59 X |
| 4,520,622 | 6/1985 | Ziemek et al. | 57/13 X |

*Primary Examiner*—Donald Watkins

*Attorney, Agent, or Firm*—Banner, Birch, McKie & Beckett

[57] ABSTRACT

A stranding machine for making multi-stranded cables or the like incorporates a rotatable filament feeding device having a plurality of elongated tubular support devices for supporting coils of the filament with their axes parallel to each other and to the axis of rotation of the device.

2 Claims, 3 Drawing Figures

STRANDING MACHINE

INTRODUCTION TO THE INVENTION

This invention relates to a stranding machine for making multi-stranded cables and the like and particularly to a device for feeding the filaments in such an apparatus.

In this specification extensive reference will be made to wire cables of the type used to transmit tensional forces. However it must be borne in mind the the invention is not directed only to such cables but to any twisted multi-stranded configuration of any suitable material. Thus the term 'filament' will be used in this specification as a general term covering strands of any suitable material. Such filaments may of course be multi-stranded themselves.

BACKGROUND TO THE INVENTION

In the art of cable or wire rope manufacture several wires are helically wound about a central core wire or king wire as it is otherwise known. The wires are located on bobbins or spools the axis of which are transverse to the direction of the axis of the cable of the time of manufacture.

These bobbins are mounted in suitable cradles, generally one behind the other in a rotating device and the wires, except for the core wire, pass through guide apertures around the periphery of an annular guide. As the device rotates the annular guide winds the wires around the central core wire in a helical manner as described above.

It will be appreciated that because of the configuration of the apparatus and particularly the broad diameter of the rotating portion thereof the rotational speed and hence the rate at which cables can be produced is limited.

An object of this invention is to provide apparatus for making cables of this type, which apparatus has the facility of working at higher speeds than known types of apparatus and has a reduced filament loading time.

SUMMARY OF THE INVENTION

According to the invention a stranding machine for making multi stranded cables or the like includes a device for feeding filaments comprising:

- at least two support devices for supporting coils of filament parallel to each other and rotatable about an axis parallel to those of the coils.

Further according to the invention the stranding machine comprises:

- at least two outer filament coil support devices arranged about a central axis of rotation;
- filament guides for the filaments of the filament coil support devices;
- means for rotating the coil support devices and filament guides in unison;
- cable tensioning means for maintaining tension on the cable and filaments during manufacture of the cable.

Further according to the invention the stranding machine includes a central support device for a core filament coil.

Still further according to the invention the filament coil supports are of elongated tubular configuration having filament feed orifices at the ends thereof adjacent the filament guides and having loading orifices at their opposite ends.

Still further according to the invention the cable tensioning means comprises a friction pulley and a suitable cable take up device.

Still further according to the invention there are at least three outer filament coil support devices and they are equally spaced from each other.

Still further according to the invention the apparatus includes a pre-forming head, a sizing die, and post-forming rolls.

Still further according to the invention the stranding machine includes filament coil cassettes for location in the coil support devices, the cassettes comprising a front end closure member having a feeding orifice therethrough, and a pay-off device for insertion in the rear of the filament coil.

BRIEF DESCRIPTION OF THE DRAWINGS

An embodiment of the invention described by way of example only follows with reference to the accompanying diagrammatic drawings in which.

DETAILED DESCRIPTION OF THE DRAWINGS

Figure 1:
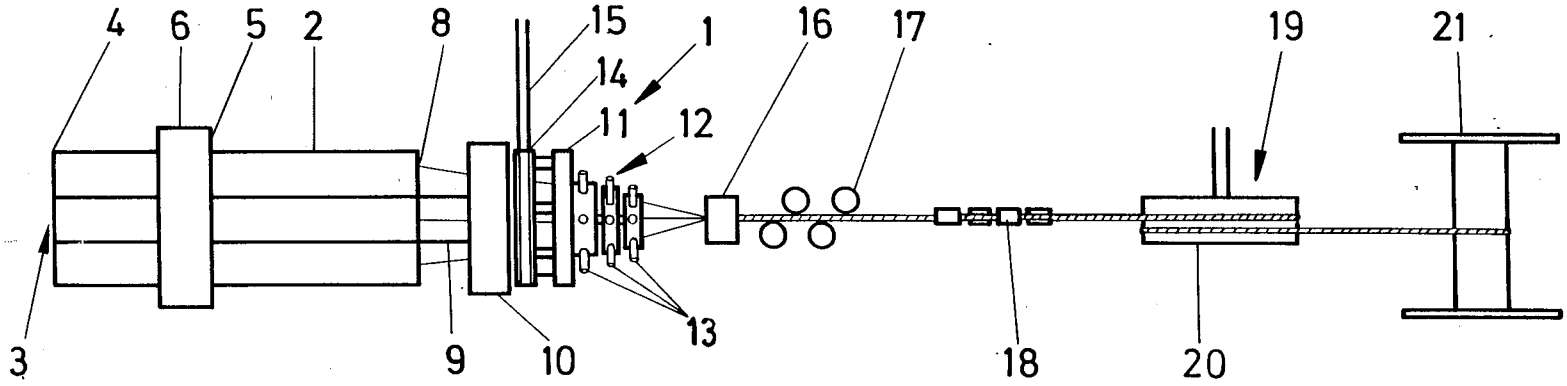
FIG. 1 is a plan of the essential integers of a cable stranding machine.

In this embodiment of the invention a stranding machine, indicated generally by numeral (1), for making multi-stranded wire cables comprises six elongated tubular filament coil support devices (2) arranged around an inner central support device (3) for a core filament.

Near their rear ends (4) the support devices (2) are supported in a suitable ring bearing (5) which in turn is located in a bearing mounting (6) adapted to be fixed to a support surface (7) such as a floor.

The support devices (2) and (3) are open at their rear ends (4) and closed at their forward ends (8) except for centrally located filament feed orifices (not shown).

At their forward ends (8) the support devices (2) and (3) are supported by an elongated tubular member (9) which encompasses the central support device (3) and projects coaxially therefrom. Near its free end this member (9) is supported in a ring bearing and mounting (10) similar to the mounting (6) near the rear end (4) of the support devices (2) and (3). The two mountings (6) and (10) thus enable the support devices (2) and (3) and the member (9) to rotate about an axis which is the same as that of the support device (3).

Located on the member (9) and spaced from the ring bearing and mounting (10) is a guide member (11) including filament guides and a filament pre-forming head (12) of the type known in the art. There is one set of pre-forming guides (13) for each of the outer support devices (2).

Means (not shown) for rotating the support devices 2 and 3, the tubular member (9) and the guide member (11) is provided in the form of an electrical motor and gear box. A suitable drive mechanism for connecting the drive means to the tubular member (9) is provided. The drawings of the specification indicate a simple pulley (14) on the tubular member (9) between the mounting (10) and the guide member (11). It is driven by way of a belt (15). However other methods such as direct drive mechanisms or sprockets and chains may also be used.

Adjacent the guide member and preforming head (12) is a sizing die (16) which is followed by a horizontal and vertical post forming rolls (17) and (18) respectively.

Spaced a short distance from the vertical rolls is a cable tensioning means (19) which comprises a friction pulley (20) around which the cable is passed. This friction pulley also includes a drive means and is well known in the art of cable manufacture.

A cable take up drum (21) is located adjacent the tensioning device (19).

The apparatus 1 is adapted for use with coils of suitable wire instead of the normally used bobbins. Such coils are of an elongated cylindrical form, have a plurality of layers, and are hollow in the centre. This hollow centre enables the coils to be unwound from the inside.

The coils are inserted into the support devices (2) and (3) and the wires are then fed from the rear of the coils over and through suitable 'pay off' members, through the centre of the coils via the guides of the guide member (11) to the centre of the member die (16) where they are wound together and tensioned by means of the tensioning device (19) before they pass over the drum (21).

As the apparatus is rotated, so the wires from the outer support devices (2) are wound around the core wire from the central support device (3) thus forming a cable which is continually drawn out of the member (9) via the cable outlet orifice and wound onto the drum (21).

Figure 3:
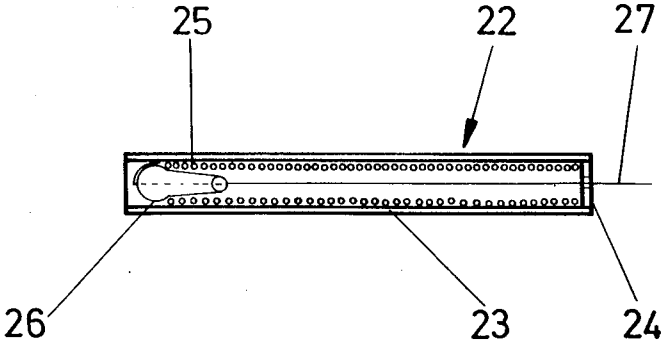
FIG. 3 is a sectional elevation of a filament cassette.
Figure 2:
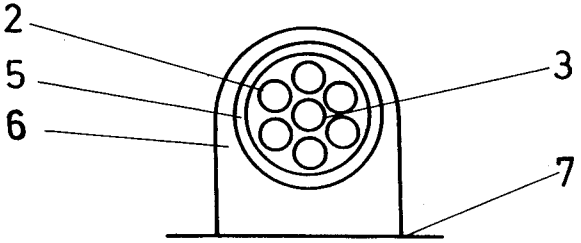
FIG. 2 is a rear end elevation of the filament coil supports.

Conveniently the coils of wire are located in tubular cassettes which enable the coils to be shared without damage occurring and to be easily loaded. The cassettes 22 as shown in FIG. 3 compress elongated tubular members 23 substantially closed at the front end except for a feeding orifice 23 in the front end closure member 24. Feeding of the wire from the coils 25 is from the rear thereof and to enable this to be effected a pay-off device 26 is located in the rear end of each coil 25. This device 26 has a smooth rounded rear surface and an orifice therethrough for the passage of the wire 27 through the centre of the coil.

As mentioned previously the apparatus has advantages over apparatus known in the art in that not only is it faster to load than the normal spool or bobbin type of apparatus, but the coils feed the wire faster. Also because of its smaller diameter the apparatus may be rotated at a higher speed than known apparatuses, thus increasing the spead of manufacture of the cable.

Other embodiments are envisaged within the scope of the invention and include other forms and configurations thereof as well as its application to the manufacture of other products.

Thus for example the coil support devices could be arranged one behind the other. It is also envisaged that the loading devices could comprise a plurality of tubes of similar configuration to the coil support devices and that once the tubes are aligned with the coil support devices the coils could simply be pushed, using a suitable apparatus into the coil support device.

I claim:

1. A stranding machine for making multi-stranded cables and the like, filament feeding means comprising elongated tubular filament coil support devices including a central support device for supporting a coil of a core filament and a plurality of winding filament support devices for supporting coils of winding filaments to be wound around said core filament, means external and intermediate the ends of said support devices for mounting the winding filament support devices symmetrically about and with the axes thereof parallel to the axis of said central support device and providing for rotation of said support devices about the axis of said central support device, said support devices having filament feed orifices at the forward ends thereof and being open at the opposite ends for loading coils of filaments therein.

2. In a stranding machine in accordance with claim 1 wherein said filament feed orifices are provided in cassettes adapted to be loaded into the rear end of said support devices and having open rear ends for receiving coils of filaments.

* * * * *